US006078260A

United States Patent [19]

Desch

[11] Patent Number: 6,078,260

[45] Date of Patent: Jun. 20, 2000

[54] METHOD AND APPARATUS FOR KEEPING TRACK OF CHILDREN

[75] Inventor: David Alan Desch, Poway, Calif.

[73] Assignees: Sony Corporation, Tokyo, Japan; Sony Electronics, Inc., Park Ridge, N.J.

[21] Appl. No.: 09/217,072

[22] Filed: Dec. 21, 1998

[51] Int. Cl.[7] ..... G06B 23/00

[52] U.S. Cl. ..... 340/573.1; 340/573.4; 340/539

[58] Field of Search ..... 340/573.1, 573.4, 340/539

[56] References Cited

U.S. PATENT DOCUMENTS

| | | | |
|---|---|---|---|
| 4,598,272 | 7/1986 | Cox | 340/539 |
| 4,630,035 | 12/1986 | Stahl et al. | 340/539 |
| 4,694,284 | 9/1987 | Leveille et al. | 340/573.1 |
| 5,014,040 | 5/1991 | Weaver et al. | 340/539 |
| 5,115,223 | 5/1992 | Moody | 340/539 |
| 5,196,825 | 3/1993 | Young | 340/539 |
| 5,245,314 | 9/1993 | Kah, Jr. | 340/573.1 |
| 5,289,163 | 2/1994 | Perez et al. | 340/539 |
| 5,525,967 | 6/1996 | Azizi et al. | 340/573.1 |
| 5,589,821 | 12/1996 | Sallen et al. | 340/573.1 |
| 5,652,569 | 7/1997 | Gerstenberger et al. | 340/573.1 |
| 5,661,460 | 8/1997 | Sallen et al. | 340/573.1 |
| 5,689,240 | 11/1997 | Traxler | 340/573.1 |
| 5,923,255 | 7/1999 | Vahdatshoar | 340/573.1 |

*Primary Examiner*—Nina Tong
*Attorney, Agent, or Firm*—Ronald P. Kananen; Rader, Fishman & Grauer

[57] ABSTRACT

A system for monitoring the proximity and location of a child by a parent includes two transceiver units which communicate wirelessly. The child unit will transmit a signal to the parent unit so that the parent unit can determined the proximity of the child unit and its direction. A safe zone may be set by controls on the parent unit. When the child unit moves beyond the safe zone, the parent unit will generate an alert.

11 Claims, 2 Drawing Sheets

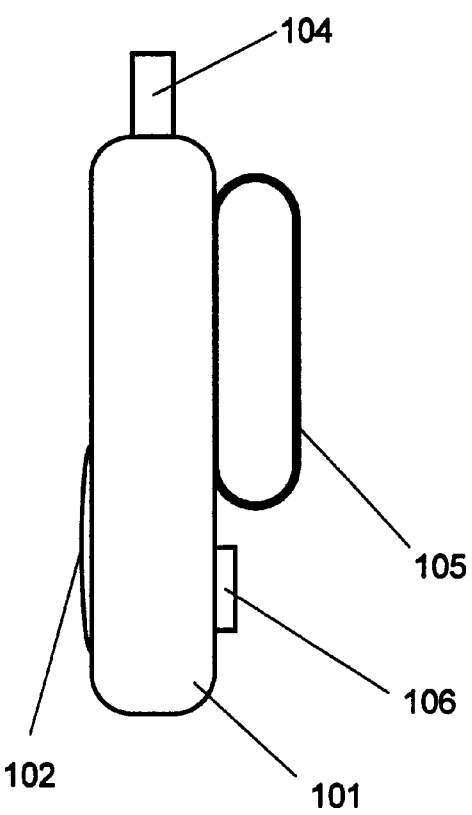
Fig. 1b
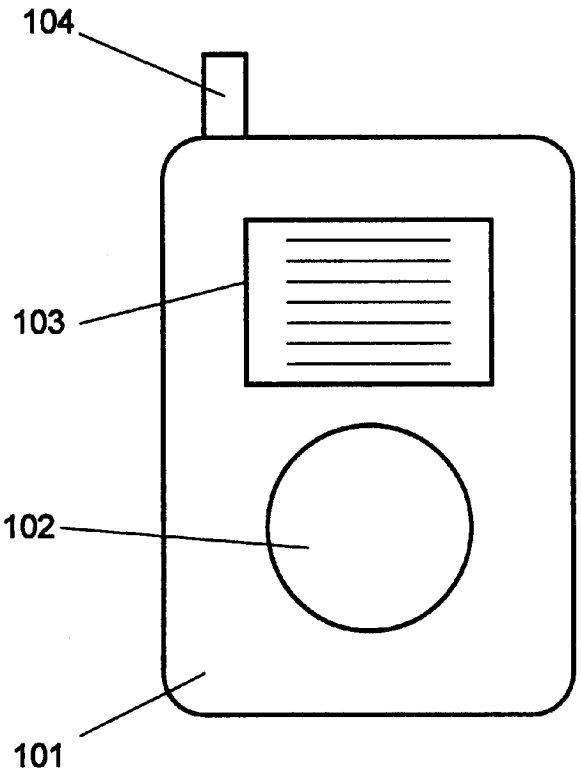
Fig. 1a
Fig. 1

METHOD AND APPARATUS FOR KEEPING TRACK OF CHILDREN

FIELD OF THE INVENTION

The present invention relates to the field of child monitoring. More specifically, the present invention relates to a device that enables parents or guardians to monitor the proximity and location of a child, particularly in a crowded or public place.

BACKGROUND OF THE INVENTION

Modern electronic devices have been used in the field of monitoring children to allow parents, guardians and caretakers more freedom while still maintaining close supervision of a child. For example, radio monitors are commonly used to listen to a child who is sleeping or playing in another room.

With a child monitor, a transmitter with a sensitive microphone is placed in the room where the child is sleeping or playing. A receiver with a speaker is then located in another room where a parent may be working or relaxing. The transmission from the microphone of the transmitter unit is played over the speaker of the receiver so that the parent can hear if the child wakes up or becomes distressed. In this way, the child can be closely supervised while giving the parent the freedom to move to other rooms of the home and complete other activities without disturbing the child.

However, such monitors are usually powered with the current from a wall outlet and are only used in the home. Consequently, such child monitors are not used to monitor a child while the parent is, for example, shopping or in some other public place.

A great fear for the parents, guardians and caretakers of children is that a child may be lost or even abducted, particularly in a crowded, public place while the parent is distracted or when the child wanders from the parent. Conventional child monitors are not designed to guard against such circumstances.

When a child is lost, it is necessary to identify the location of the child. If a child is abducted, the first few seconds are critical. The more quickly the child and the abductor are located, the less likelihood exists that the child will be harmed or that the abductor will succeed in getting away.

Consequently, there is a need in the art for a child monitoring system that allows a parent to monitor the proximity and location of a child. There is a further need for such a child monitoring system to be portable and, therefore, of use outside the home.

SUMMARY OF THE INVENTION

It is an object of the present invention to meet the above-described needs and others. Specifically, it is an object of the present invention to provide a child monitoring system and a method of monitoring children that allows a parent to track the proximity and location of a child.

Additional objects, advantages and novel features of the invention will be set forth in the description which follows or may be learned by those skilled in the art through reading these materials or practicing the invention. The objects and advantages of the invention may be achieved through the means recited in the attached claims.

To achieve these stated and other objects, the present invention may be embodied and described as a method of monitoring the proximity and location of a child by monitoring wireless transmissions from a transceiver unit attached to the child. More specifically, the method of the present invention involves using a signal transmitted from the child's transceiver to quantify the distance between the child's transceiver unit and a parent's transceiver unit.

By comparing the distance between the units to a predetermined safe range, the child's safety and whereabouts can be monitored. The method includes generating an alert when the distance to the child's transceiver exceeds the predetermined safe range. The alert is preferably an audible alert, a vibratory alert or a combination of the two from which a user can select.

The method of the present invention may also include transmitting a panic signal from the child's transceiver unit to the parent's transceiver unit. The parent's transceiver unit then generates an alert upon receipt of the panic signal. The safety of the child may be further enhanced by generating an audible alarm with the child's transceiver unit so as to call attention to the child in conjunction with transmission of the panic signal.

Conversely, when the parent is trying to locate the child, the method provides for transmitting a panic signal from the parent's transceiver unit to the child's transceiver unit; and upon receipt of the parent's panic signal, generating an audible alarm with the child's transceiver unit to call attention to the child.

The method of the present invention also assists a parent to locate a missing child by indicating with the parent's transceiver unit a direction from which the transmissions of the child's transceiver unit are received. This function may occur at all times or only when the child has transmitted a panic signal or exceeded the safe zone.

The present invention also encompasses an apparatus for monitoring the location of a mobile object, a pet or a person, particularly a child. This apparatus makes use of the method of the present invention and may consequently include a child unit having a transceiver for transmitting a wireless signal; and a parent unit for receiving the signal and determining the distance to the child unit based on the received signal.

As before, the parent unit compares the distance to a predetermined safe range and generates an alert when the distance exceeds the predetermined safe range. Preferably, the parent unit includes a control device for setting the predetermined safe range.

Preferably, the parent unit also includes a directional indicator for indicating from which direction the child's locator signal is received. The parent unit may also include a panic button such that, when the panic button is actuated, the parent unit signals the child unit and, in response, the child unit generates an alarm to call attention to the child. The child unit may also have a panic button such that, when the panic button is actuated, the child unit transmits a panic signal to the parent unit causing the parent unit to generate an alert.

Both the parent unit and the child unit may be provided with a device for attaching the respective units to a person to be worn by that person. Preferably, the child unit is worn in such a manner that it is difficult to quickly remove from the wearer. The parent unit may have a power switch that controls the powering of both the parent and child units to prevent the unwanted deactivation of the child unit.

As described above, the parent unit compares the distance to a predetermined safe range. The parent unit may also transmit a warning signal to the child unit when the distance exceeds the predetermined safe range. The child unit then generates an alert in response to receiving the warning signal.

BRIEF DESCRIPTION OF THE DRAWINGS

The accompanying drawings illustrate the present invention and are a part of the specification. Together with the following description, the drawings demonstrate and explain the principles of the present invention.

FIG. 1*a* is a front view of a child transceiver unit of a monitoring system according to the present invention.

FIG. 1*b* is a side view of the child unit of FIG. 1*a*.

DETAILED DESCRIPTION OF THE PREFERRED EMBODIMENTS

Figures 2, 2A, 2B:
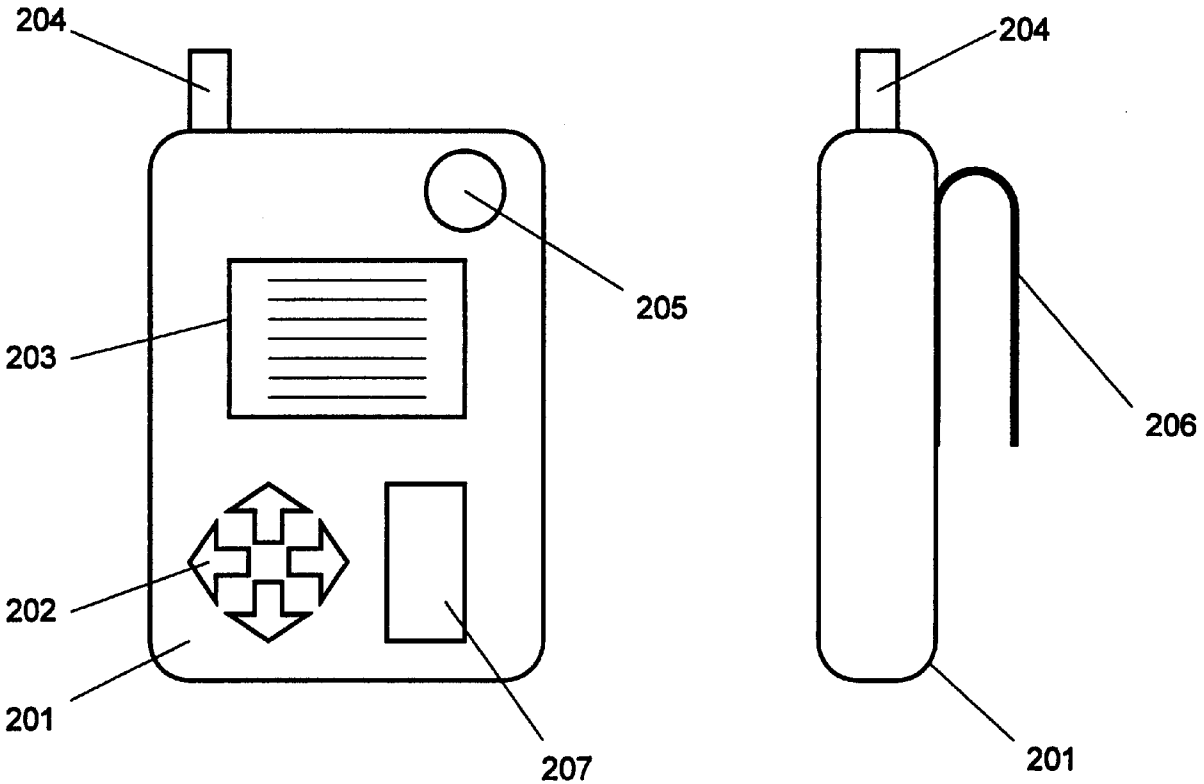
FIG. 2*a* is a front view of a parent transceiver unit of the monitoring system according to the present invention.
FIG. 2*b* is a side view of the parent unit of FIG. 2*a*.

Under the principles of the present invention, two self-contained transceiver units communicate with each other wirelessly allowing a "parent" unit to monitor the proximity and location of a "child" unit. Using the drawings, the preferred embodiments of the present invention will now be explained.

FIG. 1 illustrates an embodiment of the child transceiver unit according to the present invention. FIG. 1*a* is a front view of the child unit 101. FIG. 1*b* is a side view.

As shown in FIG. 1*a*, the child unit 101 is a transceiver which, using antenna 104, transmits a wireless signal. The signal transmitted by the child unit 101 is preferably a radio frequency signal. However, any wireless signal that can convey the proximity of the child unit 101 to a parent unit 201, as will be described in more detail below, is within the scope of the present invention.

Preferably, the signal from the child unit 101 is a digital signal with a frequency of approximately 900 MHz. This is a frequency commonly used for communications between the handset and base unit of a cordless phone. The transceiver 101 of the present invention may incorporate similar technology as will be readily apparent to those skilled in the art.

The child unit 101 may also optionally include a panic button 102. This button can be pressed by the child wearing the child unit 101 in the event the child is attacked, grabbed or otherwise in danger. When actuated, the panic button 102 will cause the unit 101 to emit a loud auditory alarm by means of a speaker 103. This alarm will call attention to the child thereby alerting others in the vicinity of the need to assist or rescue the child and assisting the child's parent in locating the child. Actuation of the panic button 102 will also cause the unit 101 to signal the parent unit resulting in an alert generated by the parent unit.

As shown in FIG. 1*b*, the child unit 101 preferably includes a belt loop 105 with which the unit 101 can be worn by a child. A belt loop 105 is preferred because it makes the unit 101 difficult to easily or quickly remove from the child. However, other means of wearing the unit 101 are within the scope of the present invention.

For example, the unit 101 could be provided with a wristband and worn on a child's wrist. The unit 101 could also be worn as a pendant around a child's neck, clipped to a child's clothing or laced to a child's shoe. Any means of wearing the unit 101 is within the scope of the invention, and those means which render the unit 101 difficult to remove from the child are preferred.

Additionally, the unit 101 may be provided with a power switch 106. If a power switch 106 is provided on the child unit 101, it should preferably be provided on the back of the unit 101 as shown in FIG. 1*b* so as to prevent the unit 101 from being easily deactivated.

FIG. 2 illustrates the corresponding parent transceiver unit of the present invention. FIG. 2*a* shows a frontal view of the unit 201. FIG. 2*b* shows a side view.

The parent unit 201 is a transceiver that, with antenna 204, receives the signal from the child unit 101. The parent unit 201 will, for example, sample the strength and direction of the signal from the child unit 101 to determine the proximity and direction of the child unit 101.

The parent unit 201 includes a control device 207 which preferably includes a power switch and a means for setting an acceptable "safe" range within which the child unit 101 should be located. In the most preferred embodiment, the child unit 101 does not have an independent power switch. Rather, when the parent unit 201 is switched on using the control device 207, a signal is sent from the parent transceiver unit 201 to the child transceiver unit 101 to activate the child unit 101. The child unit 101 is then turned on as long as the parent unit 201 is on. When the parent 201 is switched off, the child unit 101 is automatically signaled and switched off as well.

Additionally, the control device 207 can be used to adjust the range within which the child unit 101 should stay. For example, the control device 207 may be used to specify a range of five, ten, 15, 50 or more yards. When the parent unit 201 determines, based on the signal received from the child unit 101, that the child unit 101 is not within the range set by the control device 207, the parent unit 201 will generate an alert to notify the person wearing the parent unit 201.

The control device 207 may include any number of different mechanisms for accomplishing its intended purpose. For example, the control device 207 may include a marked dial which is turned to set the desired safe range for the child unit. Such a dial may also control the on/off function of the unit or units.

Alternatively, the control device 207 may include a number of buttons or switches that are used to set the safe range or to power the unit or units. Any control device capable of provided the described control functions for the unit 201 is considered equivalent for purposes of the present invention.

When the parent unit 201 determines that the child unit 101 has exceeded the safe range, the parent unit 201 will generate an alert. This alert may be a visual alert, a vibratory alert or an audible alert. Preferably, one or more types of alerts are provided and the control device 207 can be used to select the type of alert desired.

When an auditory alert is selected, the unit 201 generates the alert with a speaker 203. A visual alert would be made by, for example, a light source, preferably a flashing light source, on the unit 201. Means for generating a vibratory alert will be known to those skilled in the art.

The alert may also be used to indicate how far beyond the set safe zone the child unit 101 is. For example, if an auditory alert is selected and the set safe range is five yards, the parent unit 201 may beep once per second for each yard beyond five the child unit 101 is. Thus, if the child unit 101 is seven yards from the parent unit 201, the unit will beep twice per second. By listening to the increase in the rate of the alert beeping, the parent can also gauge how fast the child unit 101 is moving away from the parent unit 201.

If the child unit 101 exceeds the safe zone, the parent unit 201 may send a warning signal to the child unit 101. Upon receipt of the warning signal, the child unit 101 may generate an alert to warn the child that he or she has strayed from the safe zone. This alert may be visible, audible or vibratory. A control, preferably in conjunction with switch 106, may be used to activate or control the type of alert generated by the child unit 101.

The parent unit 201 preferably also includes a directional indicator 202. This indicator 202 will direct the parent to the direction from which the signal of the child unit 101 is being received. In the example illustrated in FIG. 2*a*, the unit 201 is held parallel to the ground when used to indicate the direction of the child unit 101.

Preferably, the directional indicator 202 includes four light emitting devices, e.g. LEDs, shaped as arrows pointing in four directions as shown in FIG. 2*a*. The arrow representing the direction from which the signal of the child unit 101 is being received is then illuminated. Consequently, the person using the parent unit 201 can quickly follow and locate a child, a pet or other moving object bearing the child unit.

The directional indicator 202 may be functioning at all times the parent unit 201 is on, or only when the child unit 101 has moved beyond the safe zone or transmitted a panic signal. The directional indicator 202 may be a device other than the four arrows described above which can be used to indicate the direction from which the signal of the child unit 101 is received. All such directional indicators are considered equivalent for purposes of the present invention.

As mentioned above, if the child wearing the child unit 101 actuates the panic button 102, the child unit 101 will signal the parent unit 201, and the parent unit 201 will generate an alert regardless of whether the child unit 101 is within or beyond the established "safe" zone.

Additionally, the parent unit 201 may optionally include a panic button 205. When this button 205 is actuated, a signal is sent to the child unit 101 causing the child unit 101 to emit the loud audible alarm from the speaker 103. This may assist the parent in locating the child.

The parent unit 201 may also include a device allowing a parent to comfortably wear the unit 201. As shown in FIG. 2*b*, the unit 201 preferably includes a belt clip 206 with which the unit 201 can be clipped to the parent's belt or pocket. Any other means of wearing the unit 201, including those described above in regard to the child unit 101, are within the scope of the present invention.

The preceding description has been presented only to illustrate and describe the invention. It is not intended to be exhaustive or to limit the invention to any precise form disclosed. Many modifications and variations are possible in light of the above teaching.

For example, while the present invention has been described as a means for monitoring the location of children, it could also be used to monitor the location of a pet. This would enable the owner of a pet to locate and retrieve that pet, particularly where the pet has a tendency to stray or has been allowed the freedom to explore away from home.

The present invention could also be used to keep track of another adult rather than a child. This application could be useful for two people who are hiking in the outdoors and wish to monitor each other's location. The application could also be used be people who wish to shop or sight-see separately while monitoring one another's location. In such a case, each unit might provide all the functions of both the parent and child units described above.

Additionally, a parent unit could be modified to simultaneously monitor two or more child units. If digital transmissions between units are used, the transmissions may embed a unique identifier associated with each parent and child unit pair to prevent communications between the pair from being disrupted or intercepted by a second parent/child unit pair operating in the vicinity.

The preferred embodiment was chosen and described in order to best explain the principles of the invention and its practical application. The preceding description is intended to enable others skilled in the art to best utilize the invention in various embodiments and with various modifications as are suited to the particular use contemplated. It is intended that the scope of the invention be defined by the following claims.

What is claimed is:

1. An apparatus for monitoring the location of a mobile object, a pet or a person, particularly a child, the apparatus comprising:

a child transceiver unit comprising a transmitter for transmitting a wireless signal; and a parent transceiver unit for receiving said signal and determining a distance to said child unit based on said received signal;

wherein said parent unit comprises a power switch which controls powering of both said parent and child units; said parent unit transmitting a signal to said child unit to activate or deactivate said child unit when said power switch on said parent unit is actuated.

2. The apparatus of claim 1, wherein said parent unit compares said distance to a predetermined safe range and generates an alert when said distance exceeds said predetermined safe range.

3. The apparatus of claim 2, wherein said parent unit further comprises a control device for setting said predetermined safe range.

4. The apparatus of claim 1, wherein said parent unit further comprises a directional indicator for indicating from which direction said signal is received.

5. The apparatus of claim 1, wherein said child unit further comprises a receiver and said parent unit further comprises a panic button and a transmitter such that, when said panic button is actuated, said parent unit signals said child unit and, in response, said child unit generates an alarm to call attention to said child unit.

6. The apparatus of claim 1, wherein each of said parent unit and said child unit comprise a device for attaching said respective units to a person to be worn by said person.

7. The apparatus of claim 1, wherein said child device further comprises a panic button such that, when said panic button is actuated, said child unit transmits a panic signal to said parent unit causing said parent unit to generate an alert.

8. The apparatus of claim 1, wherein said parent unit compares said distance to a predetermined safe range and transmits a warning signal to said child unit when said distance exceeds said predetermined safe range.

9. The apparatus of claim 8, wherein said child unit generates an alert in response to receiving said warning signal.

10. The apparatus of claim 1, wherein said child transceiver for selectively transmits a panic signal to said parent transceiver unit in response to actuation of an input device, wherein said parent transceiver unit generates an alert upon receipt of said panic signal;

said apparatus further comprising an audible alarm on said child transceiver unit which is sounded in response to the transmission of said panic signal to said parent transceiver unit to call attention to said child in conjunction with transmission of said panic signal.

11. A method of monitoring the location of a mobile object, a pet or a person, particularly a child, the method comprising:

determining a distance to a child transceiver unit based on a wireless signal transmitted from said child transceiver to a parent transceiver; and controlling the powering of both said parent and child transceiver units with a power switch on said parent unit, said parent unit transmitting a signal to said child unit to activate or deactivate said child unit when said power switch on said parent unit is actuated.

* * * * *